US005169336A

United States Patent [19]

Taguchi

[11] Patent Number: 5,169,336

[45] Date of Patent: Dec. 8, 1992

[54] CONNECTOR

[75] Inventor: Naoto Taguchi, Shizuoka, Japan

[73] Assignee: Yazaki Corporation, Japan

[21] Appl. No.: 788,503

[22] Filed: Nov. 6, 1991

[30] Foreign Application Priority Data

Nov. 9, 1990 [JP] Japan ..... 2-302504

[51] Int. Cl.[5] ..... H01R 3/00

[52] U.S. Cl. ..... 439/489; 439/354

[58] Field of Search ..... 439/488, 489, 350, 358; 235/462, 464, 494

[56] References Cited

U.S. PATENT DOCUMENTS 4,871,325 10/1989 Maejima et al. ..... 439/489
4,902,244 2/1990 Endo et al. ..... 439/489
4,941,839 7/1990 Nagasaka et al. ..... 439/489

FOREIGN PATENT DOCUMENTS 0109671 4/1989 Japan ..... 439/489

*Primary Examiner*—Neil Abrams
*Assistant Examiner*—Hien D. Vu
*Attorney, Agent, or Firm*—Wigman & Cohen

[57] ABSTRACT

A connector comprises a female connector member and a male connector member adapted to be fitted in the female connector member. An angularly moving arm is provided which is pivotably supported by the female connector member. The angularly moving arm is engaged with the male connector member. A detecting section is provided on the angularly moving arm and has a perforation. A reflecting section is provided on the male connector member. The reflecting section is so arranged as to be opposed to the detecting section under a condition that the angularly moving member is engaged with the male connector member. In a preferred embodiment, the detecting section includes a plurality of slits each of which has a predetermined width and which constitute a bar code.

8 Claims, 6 Drawing Sheets

CONNECTOR

BACKGROUND OF THE INVENTION

1. Field of the Invention

The present invention relates to a connector comprising a female connector member and a male connector member and, more particularly, to a connector capable of detecting whether or not a male connector member is completely fitted in a fitting hood section of a female connector member.

2. Description of the Prior Art

U.S. Pat. No. 4,902,244 has proposed a connector 1 capable of detecting imperfect fitting (i.e., half-fitting), as shown in FIGS. 1 through 3 of the attached drawings. In these FIGS. 1 through 3, the connector 1 comprises a female connector member 3 and a male connector member 7 which is fitted in a fitting hood section 5 formed in the female connector member 3.

An engaging section 9 is formed inside the fitting hood section 5 of the female connector member 3. The engaging section 9 is engaged with an engaging projection 13 of a lock arm 11 formed on the male connector member 7 under a condition that the male connector member 7 is fitted in the female connector member 3, such that the fitted condition is held or maintained therebetween.

Further, a plurality of slits 15 (15*a*, 15*b*, 15*c* and 15*d*), each of which has a predetermined width and which constitute a bar code, are formed, in spaced relation to one another, in one side of the fitting hood section 5 of the female connector member 3. A black paint is applied to a side surface 7*a* of the male connector member 7, which faces toward the slits 15, to display a bar code in accordance with the width of each of the slits 15. The bar code is detected by a bar-code scanner 21 (refer to FIG. 1B).

Furthermore, a plurality of terminal-accommodating chambers (not shown) are formed in a housing section 17 of the female connector member 3. A plurality of male-terminal metal parts (not shown) are accommodated respectively in the terminal-accommodating chambers. The male-terminal metal parts have their respective forward end portions which project into the fitting hood section 5.

On the other hand, the male connector member 7 has a connector body 19 which is formed with a plurality of terminal-accommodating chambers. A plurality of female-terminal metal parts (not shown) are accommodated respectively in the terminal-accommodating chambers. Under a condition that the male connector member 7 is fitted in the fitting hood section 5 of the female connector member 3, the male-terminal metal parts are fitted respectively in the female-terminal metal parts so as to be electrically connected thereto.

In the connector 1 constructed as described above, a method for detecting a fitted condition which judges whether or not the female connector member 3 and the male connector member 7 are completely fitted in each other, is as follows.

First, as shown in FIG. 1A, under a condition that the male connector member 7 is not fitted in the fitting hood section 5, there are no output waveforms 23 of the bar-code scanner 21 as illustrated in FIG. 1B. In this case, it is detected that the male connector member 7 and the female connector member 3 are not fitted in each other.

Next, when the slits 15 are scanned by the bar-code scanner 21 under a condition that the male connector member 7 is completely fitted in the fitting hood section 5, the output waveforms 23 are formed correspondingly to the width of each of the slits 15 formed in the fitting hood section 5 as shown in FIG. 2B. In the case where the waveforms 23 are outputted from the bar-code scanner 21, it is detected that the male connector member 7 is completely fitted in the fitting hood section 5 of the female connector member 3.

Moreover, in the case where fitting of the connector members 3 and 7 in each other is imperfect, as shown in FIG. 3A, the light from the scanner passes through a gap s between a deepest portion within the fitting hood section 5 and the forward end of the male connector member 7, as shown in FIG. 3B. Accordingly, the output waveforms of the bar-code scanner 21 have no output in this gap s. For this reason, it is possible to detect that the male connector section 7 is inserted imperfectly in the fitting hood section 5.

However, the female connector member 3 and the male connector member 7 have their respective slight dimensional errors at molding. In spite of the fact that the male connector member 7 is completely fitted in the fitting hood section 5, a gap can occur between a joining surface of the male connector member 7 and a joining surface of the fitting hood section 5, similarly to the case illustrated in FIG. 3B. For this reason, the light from the bar-code scanner passes through the gap, so that there is no output of a reflected light in this gap. Accordingly, the following problem arises. That is, in spite of the fact that the male connector member 7 is completely fitted in the female connector member 3, it is erroneously detected that the male connector member 7 and the female connector member 3 are under the imperfect fitted condition.

SUMMARY OF THE INVENTION

It is therefore an object of the invention to provide a connector capable of detecting a fitted condition between a male connector member and a female connector member, easily and reliably.

It is another object of the invention to provide a connector which does not erroneously detect a fitted condition between a male connector member and a female connector member, due to dimensional errors occurring at molding of the male and female connector members.

These and other objects, which will become apparent from the ensuing detailed description, can be achieved according to the invention by providing a connector comprising:

a female connector member;

a male connector member adapted to be fitted in the female connector member;

an angularly moving member pivotably supported by the female connector member and adapted to be engaged with the male connector member;

a detecting section with a perforation provided in the angularly moving member; and a reflecting section provided on the male connector member, the reflecting section being opposed to the detecting section under a condition that the angularly moving member is engaged with the male connector member.

DETAILED DESCRIPTION OF THE PREFERRED EMBODIMENTS

Figure 4:
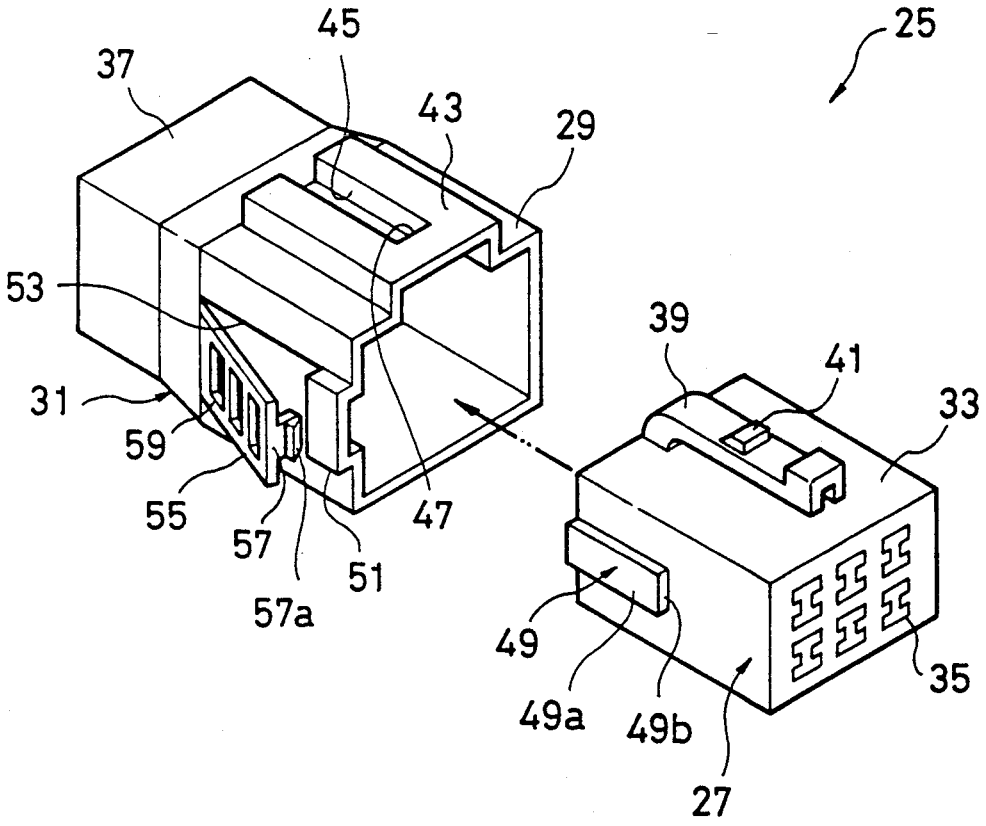
FIG. 4 is a perspective view showing a construction of a connector according to the invention, under a condition that a male connector member and a female connector member of the connector are not fitted in each other.

Referring first to FIG. 4, there is shown a connector 25 according to the invention. The connector 25 comprises a male connector member 27 and a female connector member 31 formed with a fitting hood section 29 in which the male connector member 27 is fitted.

The male connector member 27 has a connector body 33 which is formed therein with a plurality of terminal-accommodating chambers 35. A plurality of female-terminal metal parts (not shown) are accommodated respectively in the terminal-accommodating chambers 35.

Further, the connector body 33 of the male connector member 27 has an upper surface from which a flexible lock arm 39 projects. The lock arm 39 has a forward end portion which is provided with an engaging section 41. Furthermore, the male connector member 27 is provided, on its one side wall, with a protrusion section 49. The protrusion section 49 has a reflecting surface 49*a*.

On the other hand, the female connector member 31 is provided with a plurality of terminal-accommodating chambers (not shown) in a housing section 37. A plurality of male-terminal metal parts (not shown) are accommodated respectively in the terminal-accommodating chambers. The male-terminal metal parts have their respective forward end portions which project into the fitting hood section 29. Under a condition that the male connector member 27 is fitted in the fitting hood section 29, the male-terminal metal parts are fitted respectively in the female-terminal metal parts so that the male-terminal metal parts are electrically connected to the female-terminal metal parts. Moreover, a bridge portion 43 is formed on an upper surface of the fitting hood section 29 of the female connector member 31, at an outer periphery thereof. The bridge portion 43 is provided with an opening 45 having a rectangular cross-sectional configuration. The opening 45 has an inner peripheral wall surface provided with a hooking section 47. Under a condition that the male connector member 27 is fitted in the fitting hood section 29, the engaging section 41 of the lock arm 39 engages with the hooking section 47.

Further, a bridge 51 is formed on one side wall of the fitting hood section 29, which corresponds to the protrusion section 49. An opening 53 having a rectangular configuration is formed on the rear side of the bridge 51. The opening 53 is capable of being opened and closed by an angularly moving arm 55 which is pivotably supported by the fitting hood section 29 by a hinge for angular movement. The angularly moving arm 55 has a forward end which is provided with a projection 57. Under a condition that the male connector member 27 is completely fitted in the fitting hood section 29, the projection 57 engages with an end 49*b* of the protrusion section 49. Furthermore, the projection 57 has a forward end provided with a hooking section 57*a* which hooks to an edge edge of the inner wall of the bridge 51.

The angularly moving arm 55 has a detecting section preferably comprising a plurality of perforations 59 (hereinafter referred to as "slits") each of which has a predetermined width and which constitute together a detecting code (hereinafter referred to as "bar code") formed in accordance with individual information of the connector 25. The slits 59 are formed at a location opposed to the protrusion section 49 of the male connector member 27 fitted in the fitting hood section 29. The slits 59 are formed at a location apart from an angularly moving fulcrum of the angularly moving arm 55, that is, at a location nearer to an opening of the fitting hood section 29 in which the male connector member is fitted than to the fulcrum.

The operation of detecting a fitted condition of the connector constructed as described above will next be described.

Figure 1A:
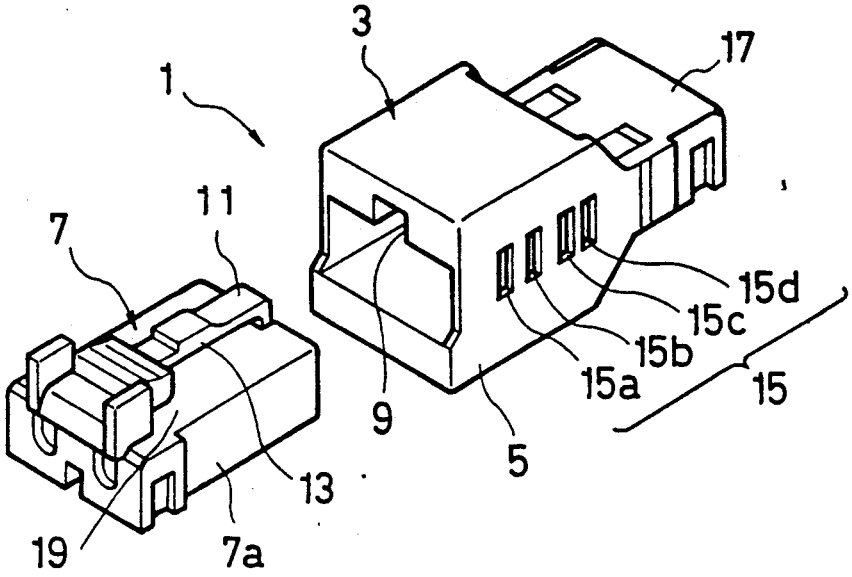
FIG. 1A PRIOR ART
FIG. 1A is a perspective view of a male connector member and a female connector member of the prior art at a condition that the members are not fitted in each other.
Figure 1B:
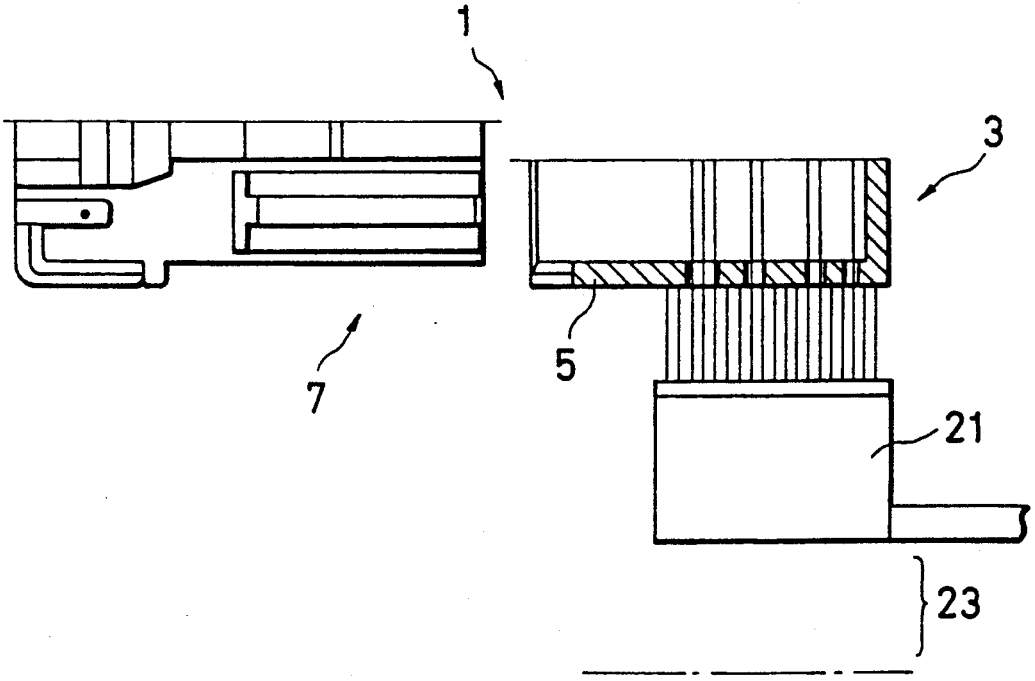
FIG. 1B PRIOR ART
FIG. 1B is a view showing an electric signal pattern at the condition illustrated in FIG. 1A, together with a fragmentary transverse cross-sectional view of a scanner and a connector comprising the male and female connector members.
Figure 2A:
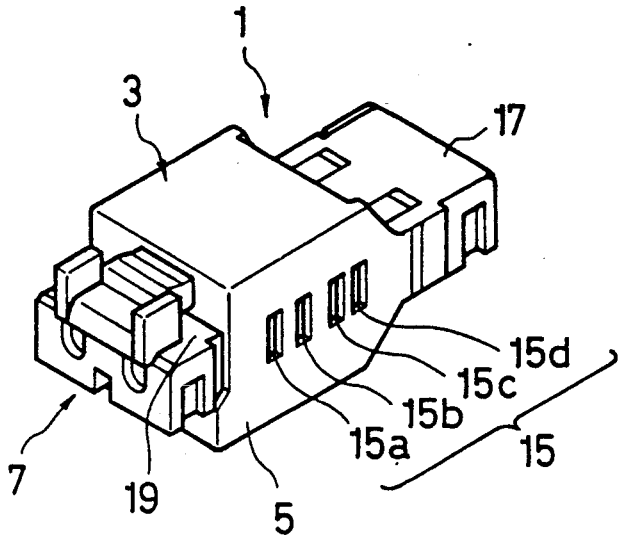
FIG. 2A PRIOR ART
FIG. 2A is a perspective view of the male and female connector members illustrated in FIG. 1A at a condition that the members are completely fitted in each other.
Figure 2B:
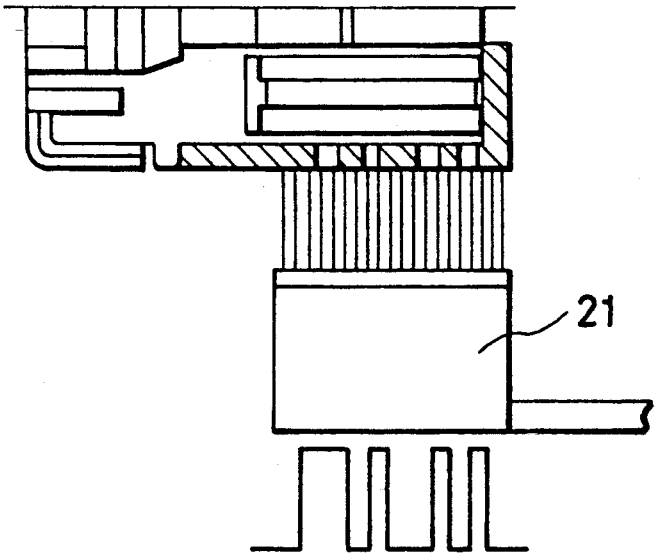
FIG. 2B PRIOR ART
FIG. 2B is a view showing an electric signal pattern at the condition illustrated in FIG. 2A, together with a fragmentary transverse cross-sectional view of the scanner and the connector.
Figure 3A:
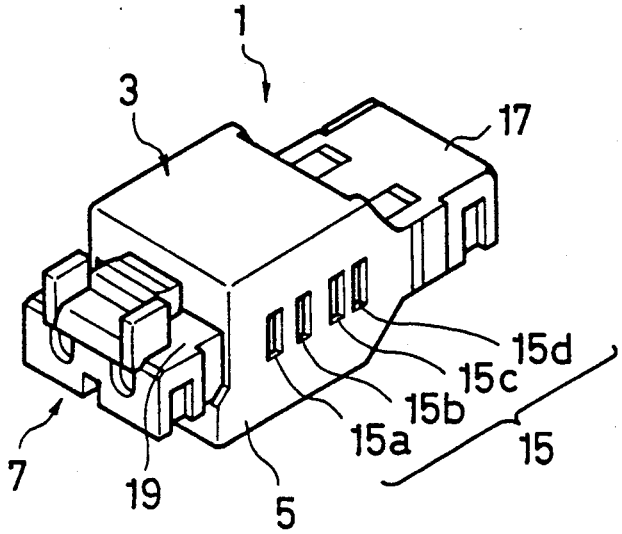
FIG. 3A PRIOR ART
FIG. 3A is a perspective view showing a condition that the male and female connector members illustrated in FIG. 1A are imperfectly fitted in each other.
Figure 3B:
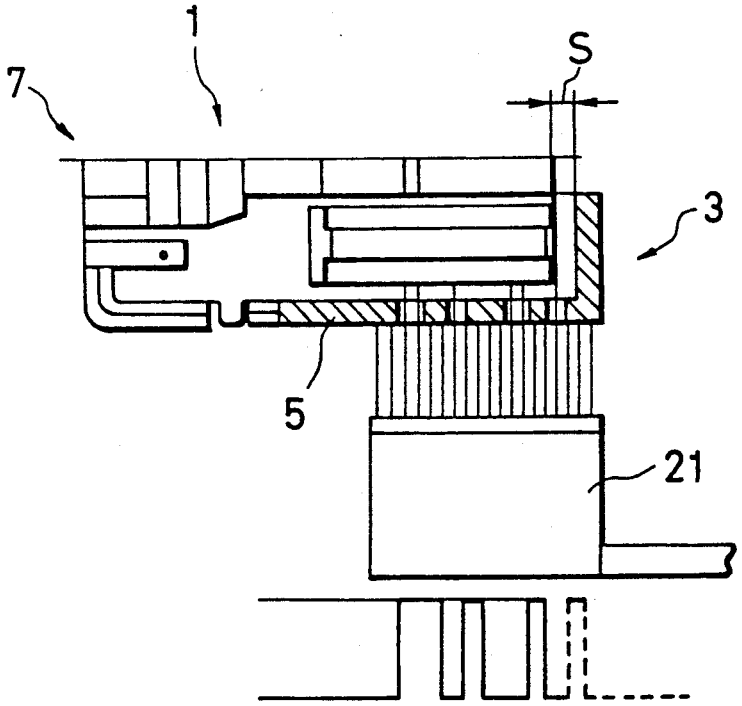
FIG. 3B PRIOR ART
FIG. 3B is a view showing an electric signal pattern at the condition illustrated in FIG. 3A, together with a fragmentary transverse cross-sectional view of the scanner and the connector.
Figure 5A:
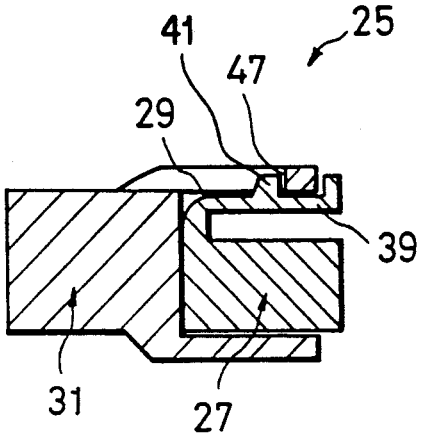
FIG. 5 is a cross-sectional view showing fitting conditions of the male connector member and the female connector member illustrated in FIG. 4, FIG. 5A being a longitudinal cross-sectional view of a completely fitted condition, FIG. 5C being a transverse cross-sectional view of the completely fitted condition, FIG. 5B being a longitudinal cross-sectional view of the imperfectly fitted condition, and FIG. 5D being a transverse cross-sectional view of the imperfectly fitted condition.
Figure 5C:
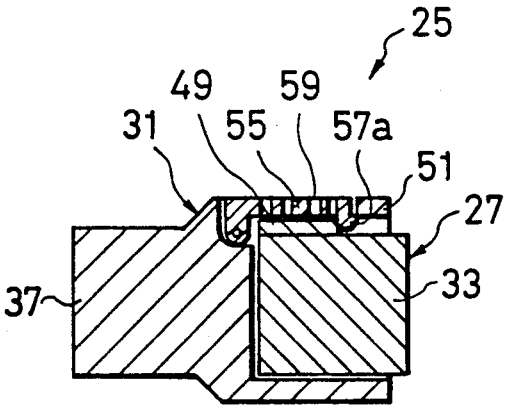
Figure 5D:
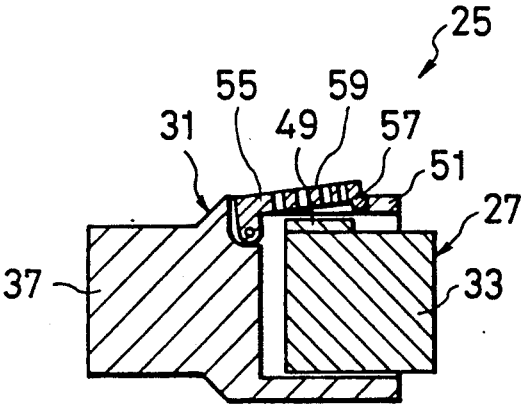
Figure 6:
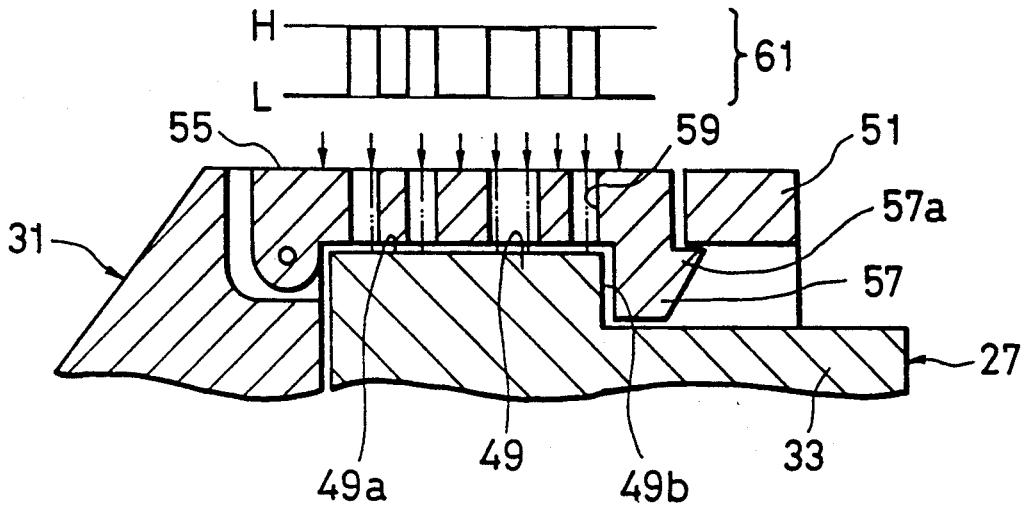
FIG. 6 is a view showing an electric signal pattern under the completely fitted condition of the connector illustrated in FIG. 4, together with a fragmentary transverse cross-sectional view of the connector.

As shown in FIG. 5A, in the case where the male connector member 27 is completely fitted in the fitting hood section 29, the engaging section 41 of the lock arm 39 is engaged with the hooking section 47 of the fitting hood section 29. As shown in FIG. 5C, the projection 57 is engaged with the protrusion section 49. Thus, the fitted condition is maintained in a doubly locked condition. Further, under this condition, the detecting portion of the angularly moving arm 55 is opposed to the protrusion portion 49 substantially in parallel relation thereto. Under this condition, when a detecting unit such as the bar-code scanner 21 (refer to FIGS. 1 through 3) or the like is used to scan the surface of the angularly moving arm 55, there can be obtained a pattern 61 of two-value electric signals (Hi and Lo) by photoelectric transference, which corresponds to the plurality of slits 59, as shown in FIG. 6. The pattern 61 of the electric signals is in agreement with an electric signal pattern under the completely fitted condition between the male connector member 27 and the female connector member 31, which is beforehand stored, whereby it is detected that the male connector member 27 and the female connector member 31 are under the completely fitted condition.

Furthermore, under this condition, since the engaging section 41 of the lock arm 39 is engaged with the hooking section 47, and the hooking section 57*a* of the angularly moving arm 55 hooks to the edge of the inner wall of the bridge 51, the fitted condition between the male connector member 27 and the female connector member 31 is maintained in a doubly locked condition.

Figure 5B:
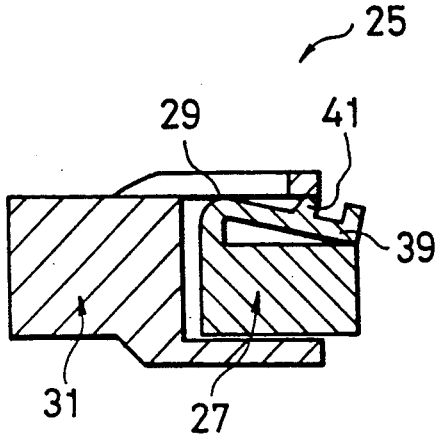

Next, as shown in FIG. 5B, in the case where the male connector member 27 is half-fitted in the fitting hood section 29, that is, in the case where the male connector member 27 is inserted into the fitting hood section 29 part of the way, the lock arm 39 is under a deflected or bent condition. Thus, the engaging section 41 is not engaged with the hooking section 47 of the fitting hood section 29. Moreover, the angularly moving arm 55 is not properly opposed to the reflecting protrusion section 49, but is inclined with respect to the protrusion section 49. The projection 57 of the angularly moving arm 55 is not engaged with the protrusion section 49 of the male connector member 27.

Figure 7:
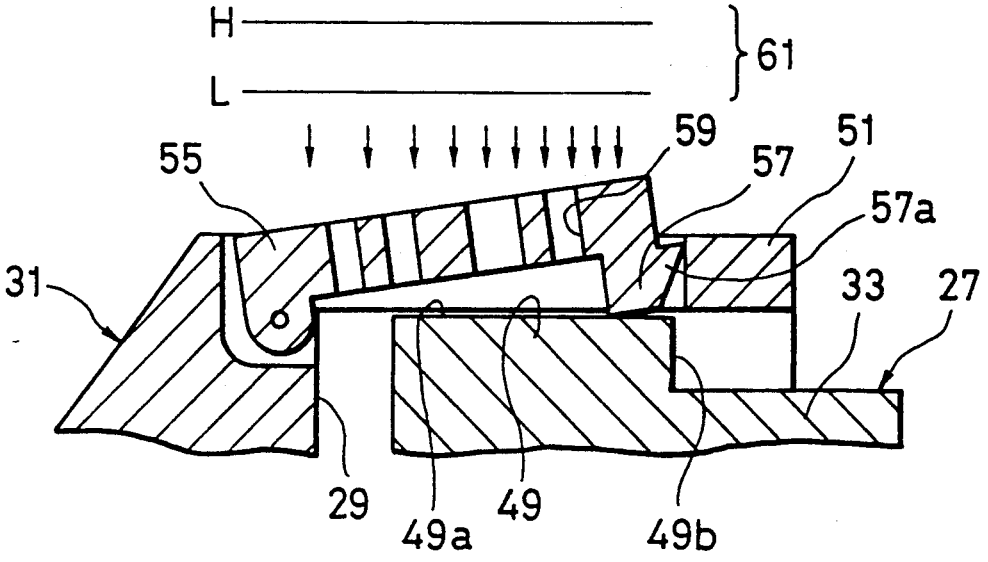
FIG. 7 is a view showing an electric signal pattern under the imperfectly fitted condition of the connector illustrated in FIG. 4, together with a fragmentary transverse cross-sectional view of the connector.

Under this condition, when the bar-code scanner 21 or the like is used to scan the surface of the angularly moving arm 55, a reflected light from the protrusion section 49, of a light applied from the bar-code scanner 21 has an optical path length which is longer than that in the case of the completely fitted condition, because the angularly moving arm 55 is inclined. Accordingly, the light reflected from the reflecting surface 49*a* is weaker than a predetermined light. As shown in FIG. 7, the electric signals are all brought to Lo signals. Thus, it is judged that the male connector member 27 is under the half-fitted condition with respect to the female connector member 31.

Next, the male connector member 27 and the female connector member 31 have dimensional errors at molding and, in the case where a gap occurs between joining surfaces of the respective male and female connector members 27 and 31 under their fitted condition, since the male connector member 27 is completely fitted in the fitting hood section 29, the engaging section 41 of the lock arm 39 is engaged with the hooking section 47 of the fitting hood section 29, the projection 57 of the angularly moving arm 55 is engaged with the protrusion section 49, the angularly moving arm 55 is substantially in parallel relation to the surface of the protrusion section 49, and the angularly moving arm 55 and the reflecting surface 49*a* are opposed to each other.

Under this condition, when the surface of the angularly moving arm 55 is scanned by the bar-code reader 21, the optical path length is equal to that under the completely fitted condition. The pattern of the detected electric signals is equal to the pattern of the electric signals in the case of the completely fitted condition.

Thus, even if a gap occurs under the completely fitted condition between the male connector member 27 and the female connector member 31 due to the dimensional errors at molding, it is judged that the male connector member 27 and the female connector member 31 are under the completely fitted condition. Accordingly, erroneous detection can be eliminated.

In connection with the above, in the above-described aspect, the lock arm 39 is engaged with the hooking section 47, and the projection 57 of the angularly moving arm 55 is engaged with the protrusion section 49, so that there is produced a double retaining structure. However, these engagements may be one.

Further, an example has been shown in which the angularly moving arm 55 is provided on the side of the fitting hood section 29. However, the angularly moving arm 55 may be provided on any locations other than the above-described location.

What is claimed is:

1. A connector comprising:

a female connector member;

a male connector member adapted to be fitted in said female connector member;

an angularly moving member pivotally supported by said female connector member and adapted to be engaged with said male connector member when said male connector member completely fits into said female connector member;

a detecting section with a perforation provided in said angularly moving member, said perforation passing light therethrough; and a reflecting section reflecting light passed through said perforation, said reflecting section provided on said male connector member, said reflecting section being opposed to said detecting section under a condition that said angularly moving member is engaged with said male connector member;

wherein said perforation is arranged so as to pass light to said reflecting section when said angularly moving member is engaged with said male connector member.

2. A connector according to claim 1, wherein said male connector member has a wall formed with a flexible lock arm, said lock arm having a forward end formed with an engaging section, and wherein said female connector member has a section to be engaged with which said engaging section is engaged at complete fitting.

3. A connector according to claim 1, wherein said reflecting section includes a protrusion section having a reflecting surface, wherein said protrusion section is formed on a wall of said male connector member.

4. A connector according to claim 3, wherein said female connector member has a fitting hood in which said male connector member is fitted, wherein said fitting hood has a wall having an opening, and wherein said angularly moving member includes an angularly moving arm which is so provided as to open and close said opening.

5. A connector according to claim 4, wherein said female connector member has a wall provided with a bridge through which said protrusion section passes at fitting, wherein said angularly moving arm is provided at a location in rear of the passage through said bridge, and wherein said angularly moving arm has a forward end provided with a projection which is engaged with said protrusion section and said bridge when said male connector member is completely fitted in said female connector member.

6. A connector according to claim 1, wherein said detecting section includes a plurality of perforations which are formed in said angularly moving member.

7. A connector according to claim 6, wherein said perforations are formed as a plurality of slits each of which has a predetermined width and which constitute a bar code.

8. A connector according to claim 7, wherein said plurality of slits are located apart from a proximal end of said angularly moving arm.

* * * * *